United States Patent [19]

Shoemaker

[11] 4,057,189

[45] Nov. 8, 1977

[54] FORCED AIR HOT WATER FURNACE

[75] Inventor: Lloyd L. Shoemaker, Cole Camp, Mo.

[73] Assignee: Lloyd's Furnaces, Cole Camp, Mo.

[21] Appl. No.: 688,741

[22] Filed: May 21, 1976

[51] Int. Cl.[2] ..... F24H 3/06

[52] U.S. Cl. ..... 237/17; 126/247; 165/58; 165/147

[58] Field of Search ..... 165/48, 58, 147; 237/7, 237/8, 16–18

[56] References Cited

U.S. PATENT DOCUMENTS

| | | | |
|---|---|---|---|
| 1,894,753 | 1/1933 | Cahoon | 165/147 |
| 3,140,824 | 7/1964 | Moore | 237/7 X |
| 3,373,802 | 3/1968 | Wiklund et al. | 165/147 X |
| 3,627,031 | 12/1971 | Ware | 165/48 X |

FOREIGN PATENT DOCUMENTS

| | | | |
|---|---|---|---|
| 142,466 | 7/1951 | Australia | 165/147 |

*Primary Examiner*—Albert W. Davis, Jr.

*Attorney, Agent, or Firm*—Schmidt, Johnson, Hovey & Williams

[57] ABSTRACT

A forced air hot water furnace including means for initially heating water and delivering the heated water to a radiator, the radiator having a fluid conduit as a part thereof, the fluid conduit having an upstream section with an orifice or passage of predetermined cross-sectional flow area, and a downstream section with an orifice or passage of reduced or smaller cross-sectional flow area whereby the water, as it passes through the conduit of the radiator, is increased in its velocity whereby to provide increased energy transfer within the radiator means, the conduit of the radiator being provided with heat transfer fins in surrounding relationship thereto.

1 Claim, 6 Drawing Figures

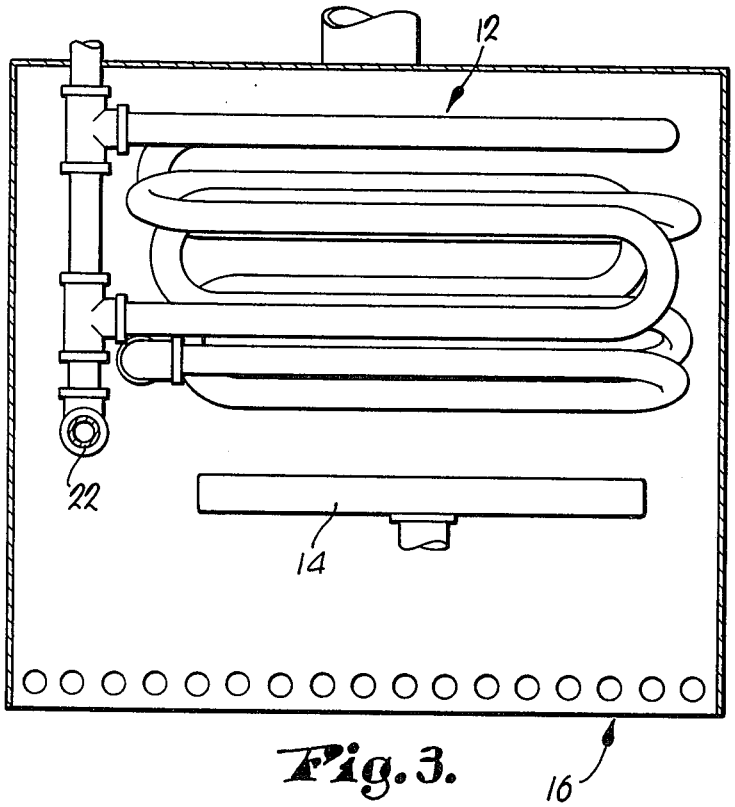
Fig. 3.
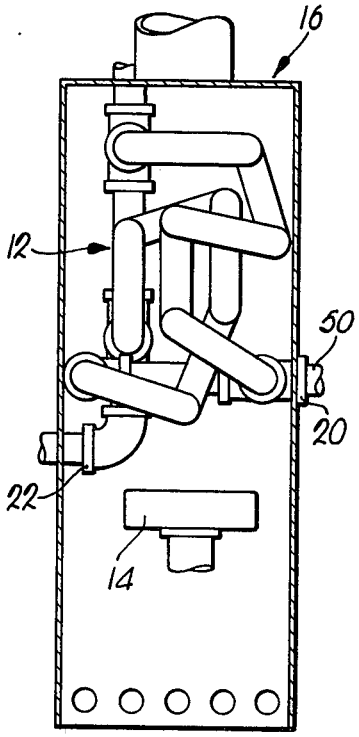
Fig. 4.
Fig. 5.
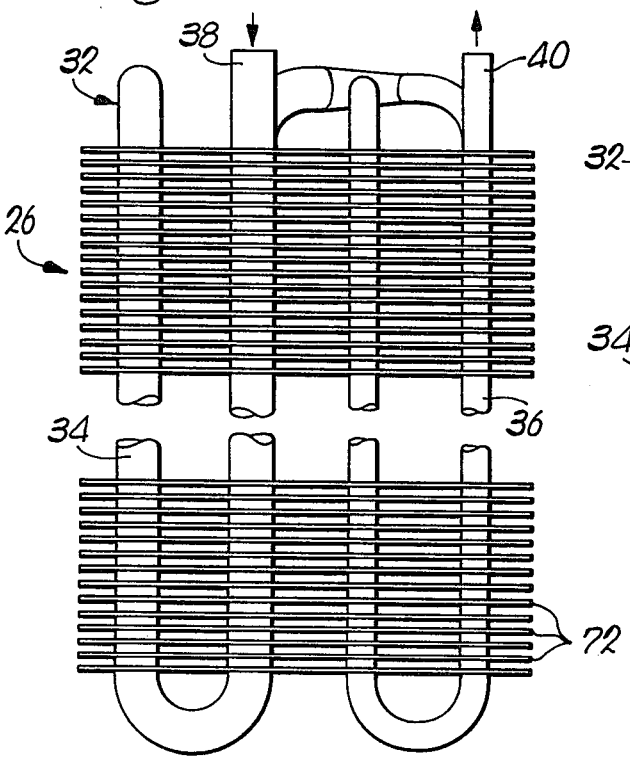
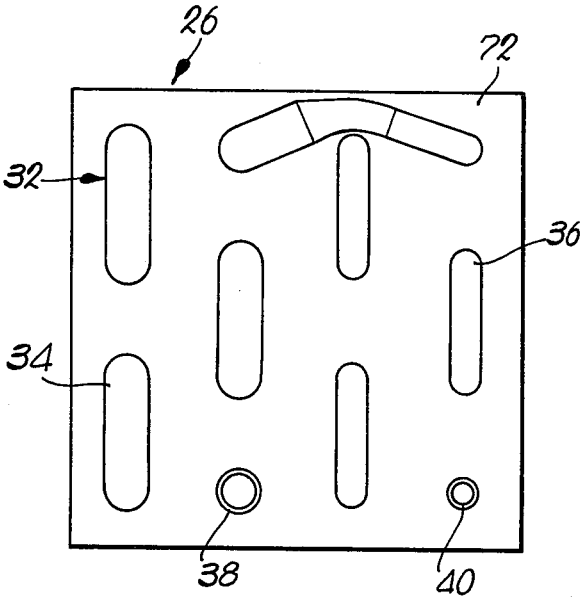
Fig. 6.

FORCED AIR HOT WATER FURNACE

This invention relates to a forced air hot water furnace which may alternatively be used as a refrigerating unit and particularly, to means for obtaining maximum efficiency from the furnace whereupon maximum energy may be extracted from the water delivered to the unit.

It is the primary object of this invention to provide a hot water furnace wherein there is presented coiled tubing for receiving water from an inlet source, there being a burner for heating the water as it passes through the coiled tubing, the water then being delivered from the coiled tubing to a radiator where it enters a fluid conduit through an upstream section, the upstream section being of a predetermined cross-sectional flow area, the water as it passes through the fluid conduit then reaching a downstream section of a smaller cross-sectional flow area whereby a greater velocity is imparted to the water as it passes through the radiator.

Other objects of this invention include the provision of a reservoir for retaining water to be used in the above described system; a pump for delivering the water from the reservoir and circulating the water within what is an essentially closed system; enclosure means for the burner and coiled tubing; and a casing for the radiators, there being a blower in communication with the casing whereby air may be passed over the radiators to deliver the heat therefrom through suitable ductwork in the area to be heated.

It is also an object of this invention to provide structure which may be alternatively utilized as a refrigerating unit as by cooling or chilling the water rather than heating the same prior to its delivery to the radiator means of the unit.

Other objects of the invention will become apparent from the following specification and accompanying drawings wherein:

FIG. 3 is an enlarged view of the means for initially heating the water;

FIG. 4 is an end view of the water heating means;

FIG. 5 is a fragmentary, elevational view of one of the radiators; and

FIG. 6 is a top plan view of the radiator shown in FIG. 5.

Figure 1:
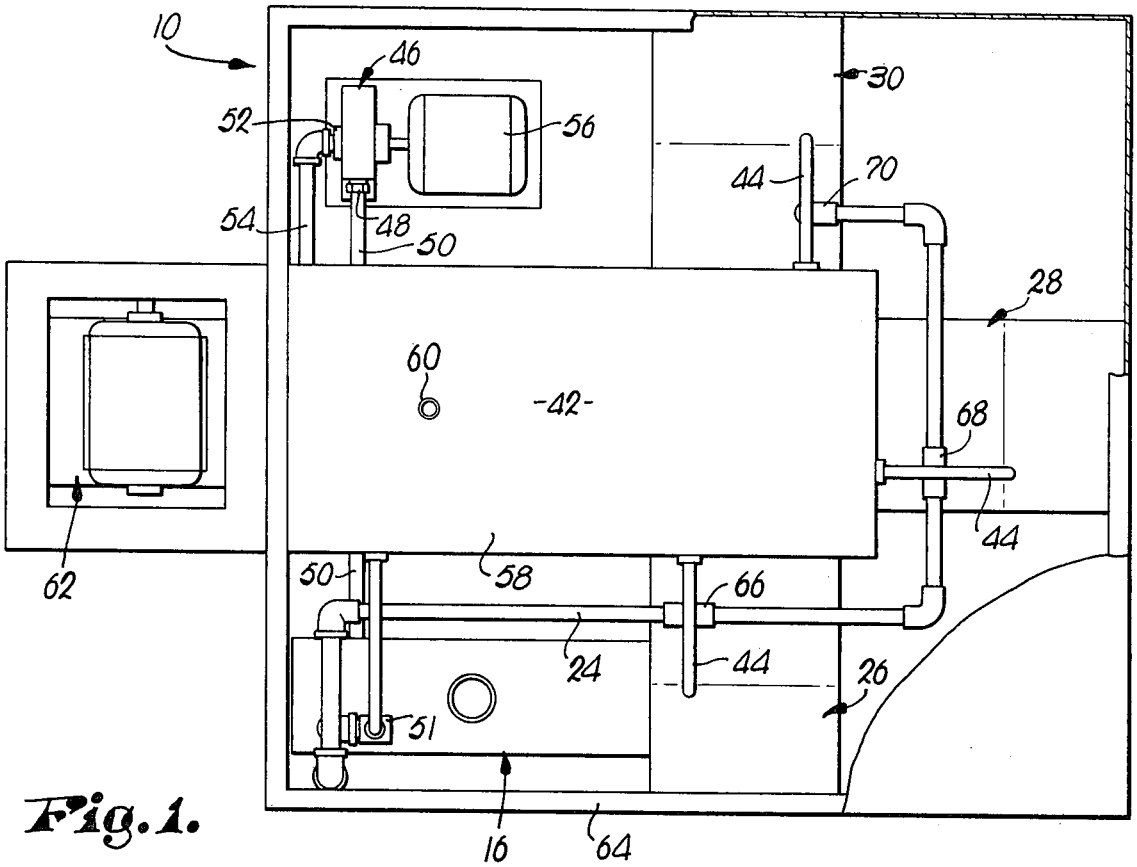
FIG. 1 is a top plan view, with portions broken away, showing the forced air hot water furnace.
Figure 2:
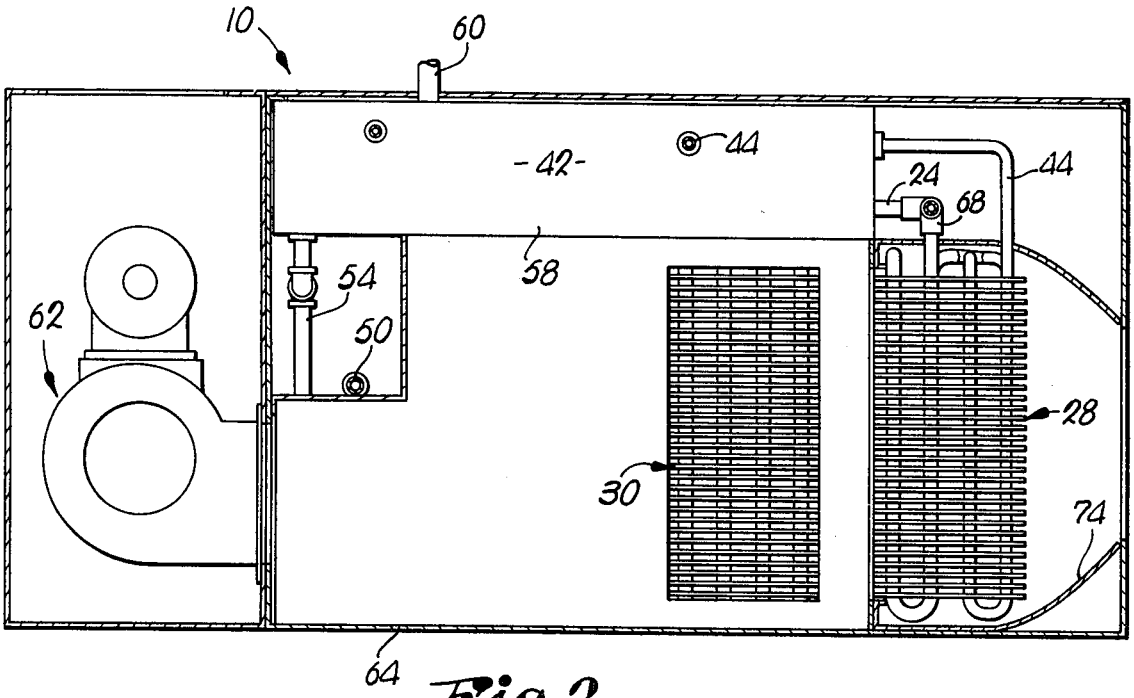
FIG. 2 is a substantially central sectional view through the furnace shown in FIG. 1.

The forced air hot water furnace 10 hereinafter disclosed, includes as its basic components a unit of coiled tubing 12 capable of being heated by a burner 14, the tubing and burner 14 being within an enclosure 16, there being pipe means for delivering water to the coiled tubing through an inlet 20, the water passing through the coiled tubing 12 where it is heated and subsequently exits through a water outlet 22.

Once the water has been heated, it passes from the coil,ed tubing 12 through suitable piping 24 to a series of radiators 26, 28 and 30. In the embodiment illustrated, three radiators are provided although it will be readily appreciated that a single radiator may be utilized and, if desired, more than three radiators might be utilized. Likewise, in the embodiment of the invention chosen for illustration, the furnace 10 is disposed in a generally horizontal position, although it will be appreciated that the components thereof might readily be arranged whereby to dispose the overall furnace in a generally vertical condition. For instance, it is within the contemplation of this invention that the furnace 10 be disposed in a vertical position and a single radiator be provided as compared with the embodiment chosen for specific illustration in the drawings forming a part hereof.

The radiators 26–30 are each identical in construction and one such radiator 26 is illustrated in FIGS. 5 and 6 of the drawings. Reference will be made only to said radiator 26, it being understood that the components and operation of all three radiators 26–30 are identical.

Thus, radiator 26, which provides for heat transfer, includes a stretch of fluid conduit broadly designated by the numeral 32, the conduit having an upstream section 34 and a downstream section 36, such sections being in communication with one another whereby to provide a single stretch of fluid conduit such as 32 which is incorporated within the radiator 26.

The upstream section 34 of conduit 32 is in communication with the water piping 24 whereby water, which has been heated within the coiled tubing 12, may be delivered therefrom through the water inlet 38 of conduit 32 and, more specifically, into upstream section 34 thereof.

Water passing into upstream section 34, which upstream section may preferably be piping having a diameter of ½ inch, subsequently passes through a reducing nipple and thence into downstream section 36, which downstream section preferably consists of piping having a ⅜ inch diameter. Subsequently, water having passed through the radiator exits therefrom through outlet 40 and passes into a reservoir 42 through return piping 44.

In order to ensure continuous flow of the water within the system of the furnace 10, there is provided a pump 46 associated with the piping and conduit of the furnace 10. Specifically, the outlet 48 of the pump 46 is in communication, through suitable piping or tubing 50, with the water inlet 20 of the coiled tubing 12 whereby water may be continuously delivered to the coiled tubing 12. The coiled tubing 12 is provided with a suitable safety relief valve 51. Likewise, the inlet 52 of the pump is in communication with the reservoir 42 as by a stretch of pipe 54 whereby water may be delivered continuously from the reservoir 42 to the pump 46 for distribution throughout the system. A suitable motor 56 is provided to operate the pump 46.

The reservoir 42 is positioned generally atop the other components of the furnace 10 and is in the nature of a tank 58 having a vent 60 whereby to provide for pressure relief. A fan or blower 62 is positioned relative to the radiators 26–30 so that air may be delivered to and through said radiators 26–30, which are positioned within a casing 64, which casing 64 likewise encloses the reservoir tank 58, the pump 46 and the motor 56 whereby a completely enclosed furnace unit 10 is presented, it being noted that the enclosure 16, which houses coiled tubing 12, is likewise disposed within the confines of casing 64.

In operation of the furnace, for heating purposes, water is placed in the reservoir tank 58 and the pump 46 is activated whereby to draw water from the reservoir tank 58 through pipe 54 and into the inlet 52 of the pump 46. This water is then delivered to outlet 48 of the pump 46 and through pipe 50 into inlet 20 of the coiled tubing 12.

Water delivered into the coiled tubing 12 is heated as by a burner 14 or other suitable means such as for instance, electricity, to a predetermined level, this being determined by the amount of heat permitted to be delivered to the coiled tubing 12 by the burner 14 or other heating means. It will be noted that the coiled tubing 12 is closely grouped and positioned in its entirety above the burner 14 so that maximum heat delivery may be achieved from the burner 14 to the water as it passes through the coiled tubing 12.

Water thus heated passes through outlet 22 from the coiled tubing 12 and through delivery pipe 24 to the three radiators illustrated in the embodiment of the invention disclosed in the drawings. Thus it will be noted that a T 66 is provided to deliver the heated water to radiator 26; a T 68 is provided to deliver water to the radiator 28; and an elbow 70 is provided to deliver water to the last radiator 30.

Viewing FIGS. 5 and 6 of the drawings, the heated water enters each of the radiators through an inlet 38 and is thus delivered into fluid conduit 32 and, more specifically, the upstream section 34 thereof, which section 34 is of a predetermined cross-sectional flow area, the water passing initially through section 34 and thence along fluid conduit 32 into a downstream section 36 thereof, which downstream section 36 is of a flow area of lesser cross-section than that of the upstream section 34.

It is particularly important to note that the flow of water through the conduit 32 from section 34 to section 36 is throttled down between said two sections, this throttling or decrease in cross-sectional flow area of the two stretches 34 and 36 of the conduit 32 taking advantage of the physical phenomina which is created when the flow of water is reduced, it being known that such reduction in the diameter of the effective flow area of the conduit creates an increased velocity and that such increased velocity results in increased fluid temperature at the point of increased velocity. In order to take maximum advantage of the heated water as it passes through sections 34 and 36, a series of fins such as 72, are attached to the fluid conduit 32 thereby creating a greater area of heat exchange.

It will be manifest that, as the water is passing through the radiators 26–30, the blower or fan 62 is selectively activated whereby to drive air through the casing 64 in a generally horizontal path, as illustrated, whereby to pick up the heat generated by such radiators and to pass the same through suitable ducting 74 outwardly from the casing 64 and through additional delivery ducts (not shown) to a point of ultimate delivery to the area to be heated.

Once water has passed through a radiator such as 26, and had the maximum amount of heat removed therefrom, due to the throttling between the sections 34 and 36 and the fins 72, the water is returned to the reservoir tank 58 by means of piping such as 44. As is apparent, the water, which is re-delivered to reservoir 42, is ultimately returned for reuse to the pump 46 so that a continuous circulatory system for the water is maintained.

It is of course to be appreciated that a certain amount of the water initially placed within the reservoir tank 58 will be lost during operation of the furnace and thus it is within the contemplation of this invention that a water delivery source would be coupled with the reservoir 42 whereby suitable outside, new water might be continuously delivered to the reservoir, there being appropriate valve means coupled with such outside water delivery means to ensure that the reservoir tank 58 is not overfilled.

It will also be appreciated that the structure herein described may be utilized for refrigerating purposes merely by deactivating the burner 14 and providing means for chilling the water in the reservoir tank 58, or as an alternative to burner 14, providing means for refrigerating the water as it passes through the coiled tubing 12 and subsequently to the radiators 26–30.

Thus, there is provided structure which may be utilized as a forced air furnace, both for heating and cooling means and which structure is of such a nature that maximum utilization of the energy inherent in the water may be achieved.

Having thus described the invention, what is claimed as new and desired to be secured by Letters Patent is:

1. A forced air hot water furnace comprising:

a reservoir provided with a supply of fluid, said reservoir having an inlet port for ingress of said fluid and an outlet port for egress of said fluid;

pump means provided with inlet and outlet ports, the inlet port of the pump being in communication with the outlet port of the reservoir;

coiled tubing having a series of interconnected, U-shaped stretches, said stretches lying in multiple, nonparallel planes, the coiled tubing having a fluid inlet and a fluid outlet, the outlet port of the pump being in communication with the fluid inlet of the coiled tubing;

means for heating the fluid in the coiled tubing;

at least one radiator provided for transfer of heat in a fluid conduit to surrounding air, said said fluid conduit having an upstream section with an orifice of predetermined cross-sectional area and a downstream section with an orifice of smaller cross-sectional flow area;

fluid coupling means between the outlet of the coiled tubing and the upstream section of the fluid conduit of the radiator; and a blower for forcing air toward said radiator means so as to pass the upstream radiator section first.

* * * * *